US005358419A

United States Patent [19]

Pejsa et al.

[11] Patent Number: 5,358,419

[45] Date of Patent: Oct. 25, 1994

[54] ELECTRICAL POWER TUBE CONNECTOR

[75] Inventors: Paul N. Pejsa, New Berlin, Wis.; John W. Newman, Bellwood, Ill.

[73] Assignee: General Electric Company, Milwaukee, Wis.

[21] Appl. No.: 113,008

[22] Filed: Aug. 30, 1993

[51] Int. Cl.[5] ..... H01R 4/60

[52] U.S. Cl. ..... 439/201; 439/272

[58] Field of Search ..... 439/190, 191, 200, 201, 439/204, 271, 272

[56] References Cited

U.S. PATENT DOCUMENTS 3,750,088 7/1973 Berian ..... 439/204
3,877,775 4/1975 Barlow et al. ..... 439/204
5,194,012 3/1993 Cairns ..... 439/201

FOREIGN PATENT DOCUMENTS 2576718 8/1986 France ..... 439/199
1545274 2/1990 U.S.S.R. ..... 439/201

*Primary Examiner*—Khiem Nguyen
*Attorney, Agent, or Firm*—James J. Lichiello; John H. Pilarski

[57] ABSTRACT

A closed cell polyolefin foam ring member serves as an oil volume expansion compensator in a high voltage electrical cable connector of an X-ray tube in which a supply of oil expands under high temperature and compresses the ring for an increase in volume for the expanding oil.

9 Claims, 2 Drawing Sheets

ELECTRICAL POWER TUBE CONNECTOR

BACKGROUND OF THE INVENTION

This invention relates to electrical connectors for electrical power tubes and more particularly to an X-ray tube high voltage electrical connector having means therein to accommodate volume changes in oil within the connector at elevated operating temperatures.

A dielectric oil is utilized in an X-ray tube and its electrical connector assembly to suppress electrical arcing between electrical conductors and the connector assembly and to maintain good electrical contact between contactors in the connector. In other regions, dielectric oil is utilized as a circulatory coolant medium. High operating temperatures of X-ray tubes contribute to interrelated problems of oil volume expansion and oil leakage particularly at the high voltage electrical connector to the tube in derogation of the required cleanliness of X-ray equipment and its environment. For this reason high voltage electrical connectors for X-ray tubes may include both sealing means and oil volume change compensation or accommodation means therein. Various oil volume expansion compensation means have been employed in such electrical connectors including, for example, special metal bellows which are confined in the connector and are compressed by the expanding oil for a net oil volume increase. Metal bellows require special handling because of their fragile nature and the particular rigorous environment of their location and function leads to unsatisfactory failure rates.

SUMMARY OF THE INVENTION

A cross linked closed cell polyolefin foam material ring member is effectively utilized in a high voltage electrical connector for an X-ray tube to accommodate oil volume changes.

OBJECTS OF THIS INVENTION

It is a principal object of this invention to provide an improved electrical power cable connector to an electrical power tube such as an X-ray tube where the connector includes means to accommodate oil volume changes of oil in the connector assembly at elevated tube operating temperatures.

It is another object of this invention to provide a non-metal oil volume change compensator in an electrical power cable connector to an X-ray tube to compensate for oil volume changes at the operating temperature of the tube.

It is a further object of this invention to provide a synthetic resin oil volume change compensating structure in an electrical power cable connector to an X-ray tube.

The invention will be better understood when taken in connection with the following drawing and description of the invention.

BRIEF DESCRIPTION OF THE INVENTION

Figure 1:
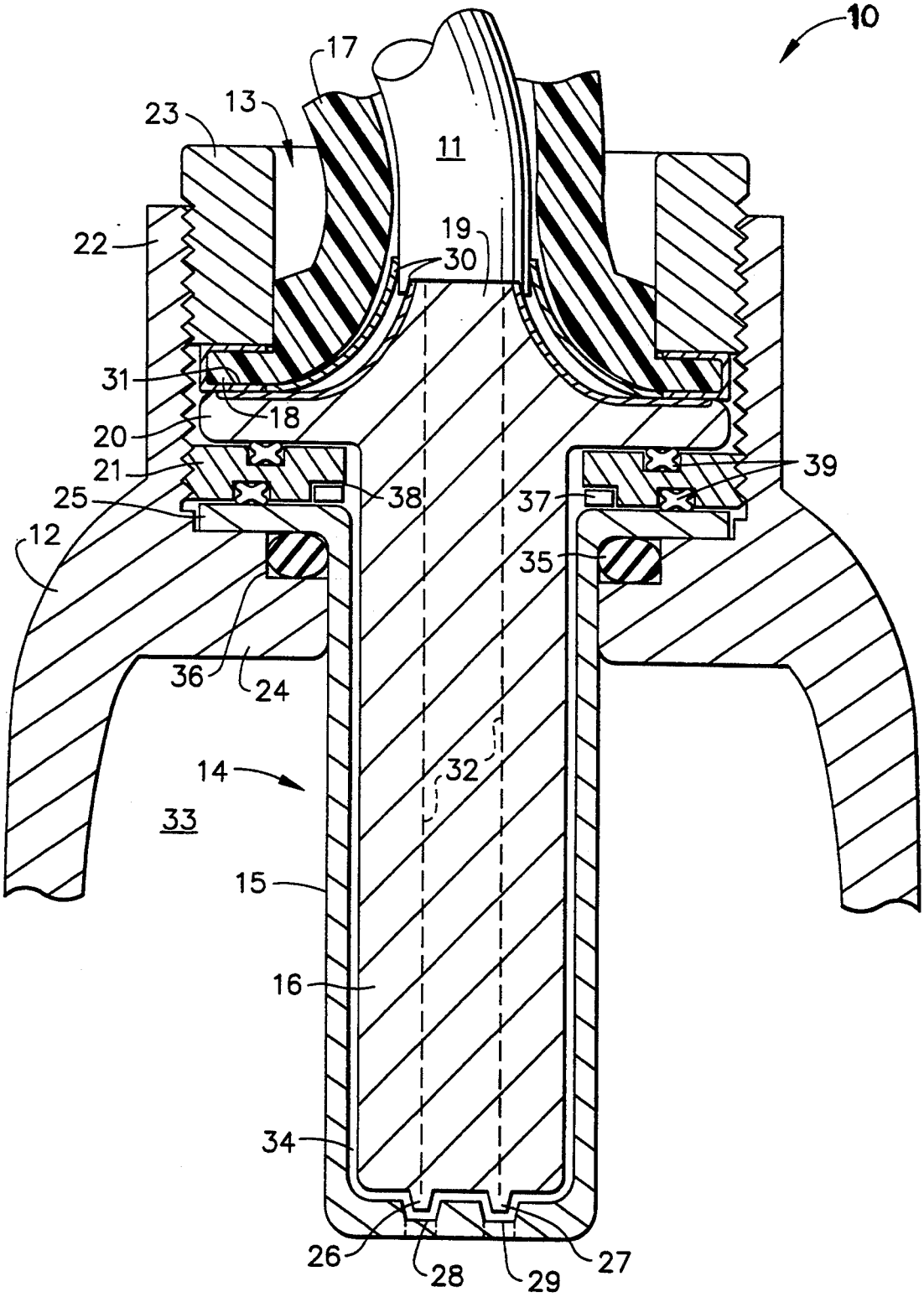
FIG. 1 is a schematic cross-section of an X-ray tube electrical connector together with its polyolefin ring oil volume compensator.

Referring now to FIG. 1, electrical connector assembly 10 connects a high voltage electrical cable 11 to an X-ray tube 12. Connector assembly 10 comprises an electrical power cable end unit 13 and plug assembly 14. Plug assembly 14 comprises a cylindrical closed end receptacle 15 in tube 12 and a generally cylindrical plug-in unit 16 adapted to be repetitively inserted into and withdrawn from receptacle 15 to connect or disconnect electrical power to the tube. Cable end unit 13 is releasably secured to plug assembly 14 and tube 12 by means of annular abutting lips on cable end unit 13 and plug-in unit 16 together with a threaded clamping ring engaging the lips and tube 12 structure. Cable end unit 13 includes a curved tubular strain relief housing 17 in which one end of cable 11 is inserted. The open end of housing 17 is radially outwardly flared to define an annular lip 18. Correspondingly, plug-in unit 16 includes a radially inwardly flaring projecting section 19 having a flare curve different from that of housing 17. Projecting section 19 is adapted to project into the flared opening of housing 17 with their defined flares in receptive relationship. The base of projecting section 19 defines an annular lip 20 corresponding to lip 18 on housing 17 so that lips 18 and 20 are engaged in concentric abutting relationship along an annular area section adjacent to their periphery. One means of support for the illustrated lip engagement comprises a threaded flange ring 21 which is threaded into an internally threaded sleeve or cylindrical projection 22 extending from tube 12 in spaced concentric and surrounding relationship to lips 18 and 20. A threaded cable locking ring 23 is threaded into projection 22 so that its leading end rests on or bears against lip 18 to press lips 18 and 20 into firmer engagement while pressing them as a unit against flange ring 21. Plug-in unit 16 is a generally cylindrical plug adapted to be inserted in and withdrawn from cup-shaped receptacle member 15 to connect or disconnect electrical power input into tube 12. The inner wall of tube 12 includes an annular inwardly directed circumferential shoulder or support flange 24 while receptacle 15 includes an annular and radially outwardly extending lip 25 thereon which concentrically overlies and is supported by shoulder 24. Flange ring 21 is threaded into sleeve 22 to press lip 25 to flange shoulder 24 to firmly fix receptacle 15 in tube 12.

Electrical power for tube 12 operation is passed from cable 11 through electrical connectors in plug-in unit 16 to exposed electrical connector contacts 26 and 27. Correspondingly a pair of recessed electrical contacts 28 and 29 in the bottom of receptacle 15 are electrically connected to the appropriate X-ray tube components requiring electrical power. With the connector 10 assembled as illustrated, with plug-in unit 16 inserted into receptacle 15 and contacts 26 and 27 inserted into recessed contacts 28 and 29, electrical power from cable 11 is passed into tube 12 for X-ray operation.

Ordinarily, electrical power requirements may dictate the need for additional exposed contacts such as contacts 26 or 27 and correspondingly additional receiving contacts such as 28 or 29 in receptacle 15.

Because of the high electrical voltages utilized in X-ray tube operation, positive electrical ground means are incorporated in connector assembly 10 of this invention. For example, the flared parts of plug-in unit 16 and housing 17 are provided with a good electrically conductive metal shield or sheath 30. Cable 11 ordinarily includes a separate electrical connector therein as an electrical ground connector, and the ground connector is appropriately brought into contact internally with a metal shield 30, for example, on housing 17. A metal channel shaped ferrule 31 encloses the peripheral edge of lip 18 in recessed but exposed relationship to electrically contact shield 30 on housing 17 as well as cable locking ring 23 and provides a more positive ground connection to cable locking ring 23 and other electrically conducting parts of tube 12.

In the assembly of connector 10, the usual rubber or plastic material of cable 11 is tightly molded to plug-in unit 16 so that when cable locking ring 23 is removed, a modest axial pulling force on cable 11 is sufficient to withdraw plug-in unit 16 from its receptacle 15 and interrupt the electrical contact between exposed contacts 26 and 27 and recessed contacts 28 and 29. The dash lines 32 between contacts 26 and 27 and cable 11 represent embedded electrical conductors in plug-in unit 16 extending between electrical conductors in cable 11 and exposed contacts 26 and 27 in plug-in unit 16.

As described, a supply of dielectric oil is utilized in tube 12 and connector assembly 10 of this invention. The oil selected is an oil of relatively high dielectric strength with good cooling properties. Such an oil will occupy space 33 in tube 12 of FIG. 1 in a quantity of several liters. This oil is circulated throughout tube 12 and appropriately cooled and recirculated as necessary. Input electrical cable 11 is the power supply for tube 12 which, in the case of an X-ray tube, may operate at about 75,000 volts. For this reason a small quantity of dielectric oil is also added to receptacle 15 in a predetermined space 34 between plug unit 16 and receptacle 15 to surround electrical contacts 26, 27, 28 and 29 therein.

As a consequence of the use of dielectric oil and the high operating temperature of an X-ray tube 12, for example at about 130° F., some slight misalignment and separation of connector elements may occur and some oil leakage from tube 12 is experienced, for example, passing from space 34 between receptacle unit 15 and plug-in unit 16 and through the threaded connection between cable locking ring 23 and sleeve 22. In order to minimize oil leakage from space 33 of tube 12 into free space in connector 10, an O ring oil seal 35 is fitted in a groove 36 in shoulder 24 between lip 25 of receptacle 15 and shoulder 24 to prevent oil passing out of space 33 in tube 12. More importantly, the high operating temperature of tube 12 causes significant oil expansion and concurrent oil volume change in connector assembly 10 which, without some control or accommodation means, exacerbates unacceptable oil leakage, particularly from medical X-ray equipment. Accordingly, oil volume expansion compensators have been combined within both tube and connectors. Such compensators have taken the form of, for example, compression absorbing devices such as thin metal bellows which undergo a reduction in volume under hydrostatic oil pressure for a net volume gain for the expanding oil. However, thin metal bellows devices have been found to be fragile, problematical and less than desirably cost effective.

In this invention, oil volume change compensation in connector 10 under operating temperatures is achieved by the use of a predetermined compressible, non-metal, cellular material ring compensator 37. As illustrated in FIG. 1, ring compensator 37 is specifically positioned in a strategic location which is a rectangular cross-section groove 38 in the inner periphery of flange ring member 21 adjacent to lip 25 on receptacle 15 and exposed to oil in space 34.

Ring compensator 37 comprises a rectangular cross-section ring formed of a flexible multi-cellular material which provides for more uniform and predetermined compression characteristics. One such multi cellular material is a synthetic resin foam material. It is preferred that such a material be, for example, a cross linked closed cell polyolefin with no open cells on its exposed surfaces. Cross linking improves the resistance of the material to hot oil while the closed cell structure provides a more uniform distribution of compressive forces and maximum compression for maximum volume compensation over many cycles of operation. The closed cell structure also assures cleanliness of the ring compensator and, as a result, cleanliness of receptacle 15. One operative example of a ring material is a closed cell cross linked polyolefin foam of a density of about 4.0 lbs./ft.$^3$ and with a rectangular cross-section. A ring as described is fitted in a larger rectangular cross-section groove 38 in ring 21 exposed to space 34. It is not intended that compensator ring 37 act as a fluid seal in its groove 38. Its primary function is to be compressed under hydrostatic oil pressure to increase the volume available for oil expansion. Plug assembly 14 includes a pair of radially outwardly extending circumferential lips such as lip 20 on plug 16 and lip 25 on receptacle 15 with flange ring 21 extending oppositely or interposed between lips 20 and 25. Compensator ring 37 is in the inner periphery of ring 21 to encircle plug-in unit 16 and be hydrostatically exposed to hot oil in space 34. "Hydrostatically exposed" indicates that compensator ring 37 is not a sealing ring and hot oil may surround the ring it its larger groove 38 to provide multi directional compression similar to, for example, a "submerged in liquid" compression.

Figure 2:
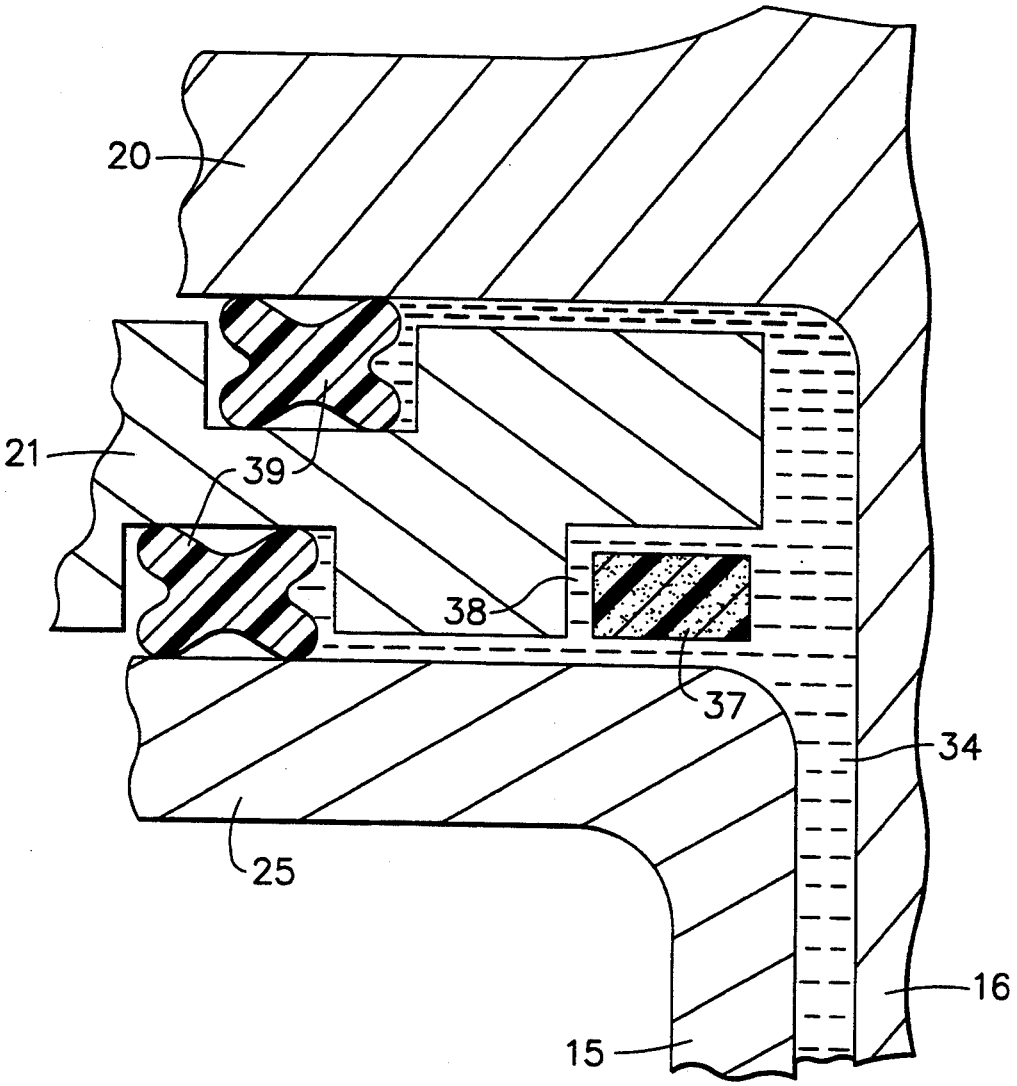
FIG. 2 is an enlarged partial and cross-sectional view of a segment of FIG. 1 with the ring oil volume compensator of this invention.

One example of a ring 37 of this invention is illustrated in FIG. 2 which is enlarged for the purpose of clarity. FIG. 2 shows a smaller cross-section ring 37 positioned in a larger groove 38 so that expanding oil from space 34 surrounds ring 37 to hydrostatically compress ring 37 for a volume reduction and a net volume gain for the expanding oil. By providing additional volume for oil expansion, sealing requirements for other O ring seals exposed to the hot oil expansion are somewhat reduced. Examples of other O ring type seals closely adjacent compensator 37 (FIG. 1) are quad ring seals 39 in appropriate grooves in ring 21. Seals 39, in cross-section, describe a four lobed structure for improved sealing characteristics.

One operative dimensional example of ring compensator 37 includes a ring about 1.5 in. (3.81 cm.) inside diameter and 1.86 in. (4.72 cm.) outside diameter with a cross-sectional thickness of 0.150 in. (0.381 cm.).

This invention provides an improved electrical coupling connector for electrical power tubes, and particularly X-ray rubes, in which a closed cell synthetic resin foam ring serves as an oil volume expansion compensator. By means of this invention, the use of metal bellows has been obviated and a lower cost and more effective compensator is provided for various electrical devices in which a supply of dielectric fluid expands under elevated temperature in the device with concurrent fluid leakage, and hydrostatic compression of a closed cell polyolefin material is applicable.

While this invention has been described with respect to one preferred embodiment thereof, it will be understood by those skilled in the art that various changes and modifications may be made without departing from the spirit and scope of this invention.

What is claimed:

1. In an electrical power tube having a generally cylindrical electrical plug-in unit thereon adapted to have an electrical input cable connected thereto and which is exposed to volume expansion of hot oil in said tube leading to oil leaking past said plug-in unit, the improvement comprising, (a) a non-metal volume compensator ring encircling said plug-in unit and exposed to said volume expansion of hot oil to be compressed by said oil to thereby increase the available volume for oil expansion and minimize oil leakage past said plug-in unit, (b) said compensator ring comprising a closed cell cellular synthetic resin material.

2. The invention as recited in claim 1 wherein said compensator ring is a closed cell synthetic resin foam material having no exposed open cells on its external surface.

3. The invention as recited in claim 1 wherein said synthetic resin comprises a cross-linked polyolefin resin.

4. In an electrical power tube having an electrical connector assembly adapted to connect an electrical power input cable to said tube, and a generally cylindrical electrical plug-in unit in said connector assembly which is exposed to volume expansion of hot oil in said connector assembly which causes oil leakage past said plug-in unit and out of said connector assembly, the improvement comprising, an expanding oil volume compensator in said connector assembly and hydrostatically exposed to said hot expanding oil, comprising in combination (a) said plug-in unit having a pair of spaced apart radially extending circumferential lip members thereon, (b) said tube having a radially inwardly extending circumferential flange ring therein interposed between said lip members and encircling said plug-in unit, (c) a non-metal expanding oil volume compensator ring member in said flange ring, between said flange ring and said plug-in unit to encircle said plug-in unit and be hydrostatically exposed to hot oil in said plug assembly, (d) said non-metal expanding volume compensator comprising a synthetic resin cellular material ring adapted to be hydrostatically compressed by said hot expanding oil to provide an increased volume therefor.

5. The invention as recited in claim 4 wherein said volume compensating ring member is a closed cell synthetic resin foam material having no open cells exposed on its external surface.

6. The invention as recited in claim 4 wherein said circumferential flange ring includes a groove in its internal periphery surface and said volume compensating ring resides in said groove.

7. The invention as recited in claim 5 wherein said volume compensating ring member is a closed cell cross linked polyolefin foam material.

8. In an electrical X-ray generator tube having a combined electrical connector and plug-in unit thereon, the improvement of a hot oil volume compensator in said plug-in unit comprising in combination (a) a generally cylindrical closed end electrical receptacle in said X-ray tube and adapted for said plug-in unit to be inserted therein, (b) said receptacle having electrical contacts and a supply of dielectric oil therein, (c) an electrical input cable section adapted to be connected to said plug-in unit to provide electrical power into said X-ray generator tube, (d) said receptacle having a radially extending circumferential lip member thereon, (e) said tube having a radially inwardly extending circumferential flange ring therein, (f) said flange ring extending to overlie said receptacle lip with its periphery closely adjacent said plug-in unit, (g) said flange ring having a groove therein in its inner periphery which is exposed to expanding hot oil in said receptacle, and (h) an easily compressible cellular synthetic resin oil volume compensator ring in said groove and hydrostatically exposed to said expanding hot oil.

9. The invention as recited in claim 8 wherein said compensator ring comprises a closed cell cross linked polyolefin foam material having no exposed cells on its external surface.

* * * * *